US006956957B1

(12) United States Patent
Azima et al.

(10) Patent No.: US 6,956,957 B1
(45) **Date of Patent: *Oct. 18, 2005**

(54) LOUDSPEAKERS

(75) Inventors: Henry Azima, Cambridge (GB); Martin Colloms, London (GB); Martin Roberts, Suffolk (GB); Graham Bank, Cambridgeshire (GB); Neil Harris, Cambridge (GB); Bijan Djahansouzi, London (GB)

(73) Assignee: New Transducers Limited, Cambridgeshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/341,295

(22) PCT Filed: Jan. 5, 1998

(86) PCT No.: PCT/GB98/00014

§ 371 (c)(1),
(2), (4) Date: Sep. 7, 1999

(87) PCT Pub. No.: WO98/31188

PCT Pub. Date: Jul. 16, 1998

(30) Foreign Application Priority Data

| | | |
|---|---|---|
| Jan. 9, 1997 | (GB) | 9700363 |
| Jun. 6, 1997 | (GB) | 9711593 |
| Sep. 4, 1997 | (GB) | 9718730 |

(51) Int. Cl.[7] ..... H04R 25/00

(52) U.S. Cl. ..... 381/431; 381/152; 381/423; 381/425; 381/396; 381/398; 181/171; 181/172; 181/169

(58) Field of Search ..... 381/425, 423, 381/424, 426, 427, 428, 152, 337, 431, 396, 398; 181/167–170, 171–172, 150

(56) References Cited

U.S. PATENT DOCUMENTS

| | | | | |
|---|---|---|---|---|
| 3,247,925 | A | * | 4/1966 | Warnaka |
| 3,553,392 | A | | 1/1971 | Liebscher et al. ..... 179/115.5 |
| 3,772,466 | A | * | 11/1973 | Hossbach |
| 4,055,732 | A | | 10/1977 | Yoshimura et al. ..... 179/117 |
| 4,323,737 | A | * | 4/1982 | Shimada |
| 4,362,907 | A | * | 12/1982 | Polacsek |
| 4,392,027 | A | | 7/1983 | Bock ..... 179/181 W |
| 4,720,868 | A | | 1/1988 | Hirano ..... 381/182 |
| 5,894,263 | A | | 4/1999 | Shimakawa et al. ..... 340/388.1 |
| 6,058,196 | A | * | 5/2000 | Heron |
| 6,208,237 | B1 | | 3/2001 | Saiki et al. ..... 340/388.1 |

OTHER PUBLICATIONS

Azima et al., "Electro–Dynamic Exciter", U.S. Appl. No. 09/355,312, filed Jan. 30, 1998 (as PCT/GB98/00307) including copy of PCT/GB98/00307, IPER and Preliminary Amendment filed with application.

* cited by examiner

*Primary Examiner*—Huyen Le
*Assistant Examiner*—Dionne Harvey
(74) *Attorney, Agent, or Firm*—Foley & Lardner LLP

(57) ABSTRACT

A loudspeaker drive unit comprising a resonant acoustic radiator, an exciter on the radiator to apply bending wave energy to the radiator to cause it to resonate, a support for the loudspeaker drive unit, and means resiliently coupling the exciter to the support.

19 Claims, 11 Drawing Sheets

LOUDSPEAKERS

BACKGROUND

The invention relates to loudspeakers of the kind in which an acoustic output is produced by applying bending waves to an acoustic radiator comprising a resonant member, e.g. a panel-form member, to cause it to resonate. Such loudspeakers are described in International patent application WO97/09842 of Verity Group plc later assigned to New Transducers Limited.

A vibration exciter for exciting such a resonant member needs a form of fixture onto the member to allow the best possible conversion of drive power into bending waves. An inertial reaction exciter applies a push/pull force to the member by reacting against the inertia of the driver mass and can be suitable.

FIGS. 1 and 2 show a known form of resonant panel-form loudspeaker (10) with one known kind of inertial reaction vibration exciter or transducer (see FIG. 11*b* of International application WO97/09842). (FIG. 1 is schematic, whilst FIG. 2 gives sectional detail of the exciter). Thus while FIG. 1 shows parts of the exciter exploded apart in the interests of clarity, it will be clear from FIG. 2 that in practice the parts of the exciter are closely arranged. The panel loudspeaker (10) comprises a vibration exciter (12) which is attached to one side of a stiff lightweight resonant panel (14). The exciter (12) includes coil winding (16) which is rigidly fixed, e.g. by means of an adhesive, on the outside of a coil former (18) to form a voice coil assembly (20) which is rigidly bonded to surface skin (22) of the panel (14), e.g. by means of an epoxy adhesive bond. Magnets (24) are enclosed by a pair of poles (26), one of which is disc-like and is disposed with its periphery close to the interior of each coil former (18), and the other of which has peripheral flange (28) arranged to surround the coil assembly (20). The magnet assembly (24,26) is secured to the surface of the panel (14) by means of a resilient suspension (30), e.g. of rubber, which is attached to the periphery of the flange (28) of the outer pole piece (26).

FIG. 3 illustrates another known resonant panel-loudspeaker (32), (see FIGS. 7*a*,7*b*,7*c* of International application WO97/09842) comprising an exciter (12) which is attached to one side of resonant panel 14). The exciter (12) is similar to that described with reference to FIGS. 1 and 2, in that it has a voice coil assembly (20) and magnet assembly (24,26). The voice coil assembly (20) is rigidly coupled to the panel (14) and the magnet assembly is secured to a frame (34) and resiliently rigidly secured to the panel (14) by means of a resilient suspension (30), e.g. of rubber. In practice, a resilient suspension is disposed around the periphery of the panel (14) and is coupled between the panel (14) and the frame (34), but in the present drawing this has been omitted for simplicity. By rigidly coupling a frame (34) to the magnet assembly (24,26), the advantages and disadvantage noted hereinafter may result.

A resonant panel loudspeaker driven by an electrodynamic exciter has a substantially flat sound pressure level response with frequency. There will, however, be a frequency below which the drive force to the panel will fall. It is possible to reduce this frequency and hence extend the bandwidth of the panel loudspeaker by increasing the inertia of the exciter magnet assembly. This may be achieved simply by adding more mass to the exciter magnet assembly or alternatively by coupling the exciter magnet assembly to a more massive body, for example to a support frame although both of these approaches can be disadvantageous in some respects. Thus an increase in the inertia of the exciter renders the exciter more sensitive to damaging shock during transportation or during handling, with the possibility even of damage to the resonant panel itself, while coupling the exciter rigidly to a support causes the exciter to cease to be truly inertial and instead couples drive energy to the support.

SUMMARY OF THE INVENTION

It is among the objects of the present invention to provide a novel loudspeaker drive unit comprising a resonant acoustic radiator.

From one aspect the invention is a loudspeaker comprising a resonant acoustic radiator, an exciter coupled to the radiator to apply bending wave energy to the radiator to cause it to resonate, the exciter comprising a voice coil assembly and a magnet assembly, a support for the loudspeaker drive unit, and coupling means for resiliently coupling the exciter to the support.

Coupling the exciter magnet assembly to a frame or the like support confers the advantage of increasing reliability and robustness while providing a resilient coupling can reduce the level of energy imparted to the support. The panel itself may be a fairly lightweight structure, whilst the exciter may be much heavier than the panel particularly in the case of an electrodynamic device.

During rough handling or shipping it is possible for the exciter to move undesirably and even cause the pole pieces to contact with the windings of the voice coil, with obvious disastrous results. By coupling the exciter magnet to the frame it is possible to produce an assembly with much improved durability than one with the exciter "free"; as in FIGS. 1 and 2.

The resilient coupling of the exciter to the support may reduce the tendency for the support and drive means to move with the same velocities, and may even obviate coincidence of velocities altogether. Thus, in operation, the panel may not be moving with either the same amplitude or even the same phase as the support. Furthermore, the choice of resilient coupling offers the designer freedom to "tune" resonant panel-form loudspeakers in a manner analogous to optimising multi-cavity and multi-vent loudspeaker systems.

For designs where the compliance is set to a low value, the exciter may be more rigidly held by the support frame and may result in a better resistance to mechanical shock together with a reduced roll off rate for the acoustic output at low frequencies applicable to some environments.

With median compliance values for the resilient element the higher frequency components of velocity present in the exciter are beneficially more weakly coupled to the support frame and this may reduce the stray acoustic output which the support frame may radiate.

With higher compliance for the resilient coupling component it may be beneficially tuned in association with the moving mass component of the exciter as is explained further below.

The support may also be resiliently coupled to the resonant member. The resilient coupling between the resonant member and the support may be spaced from contact between the resonant member and vibration exciter.

The vibration exciter may comprise an inertial vibration exciter. The inertial vibration exciter may comprise a magnet assembly and motor coil. The motor coil may be rigidly mounted to the resonant member, and the magnet assembly may be resiliently mounted to the resonant member as well as to the support.

The means resiliently locating the exciter on the support may comprise a resiliently flexible member connecting the exciter and the support. The support may comprise a structure on which the radiator is resiliently suspended. The structure may comprise a frame surrounding the radiator. A resilient suspension means may be provided and by which the radiator is suspended on the structure. The resilient suspension may be connected to the radiator at positions near to the edge of the radiator.

The means resiliently locating the exciter with reference to the support may be arranged to allow free motion of the exciter in an intended axial direction and to prevent motion of the exciter orthogonally of the axis. Where the radiator is a flat plate-like member, the axis may be orthogonal to the plane of the radiator.

From another aspect the present invention provides a loudspeaker comprising a resonant acoustic radiator, a support body for the acoustic radiator, at least one vibration exciter coupled to the radiator to apply bending waves to the radiator to cause it to resonate to produce an acoustic output, and means on the body resiliently suspending the exciter for free axial movement relative thereto so that the exciter is wholly mounted on the acoustic radiator in as far as concerns its axial operating motion to launch bending waves into the radiator. Thus the exciter is suspended on the body so that it is fixed against radial movement, that is to say movement in the plane of the radiator. The means suspending the exciter on the body may function in much the same way as the spider in a conventional pistonic loudspeaker drive unit. Thus the suspension means may be plate-like and may be formed with a series of circumferential and radial slits forming arms, the free ends of which form an outer part of the plate which can be fixed to the body while an inner part of the plate can be fixed to the transducer for the intended axial movement, while the plate remains stiff in its plane to prevent radial movement. A heat sink may be fixed to the exciter to assist in cooling the transducer.

The support body may take the place of a chassis or basket in a conventional loudspeaker drive unit, although in the present invention the support body is usually not required to be of the same degree of weight and rigidity as is required with a conventional pistonic drive unit. The support body (hereinafter support or support frame) may be a lightweight frame-like structure.

The support frame may be such as to enclose the radiator panel. The frame may be a tray-like member having a surrounding peripheral lip. The frame may be of light weight and may, for example, be a plastics moulding. The frame may be open, or may be perforate or may instead form a closed structure.

Means may be provided for resiliently suspending the acoustic radiator on the frame. The frame may be formed with means whereby it can be supported in position to form a loudspeaker.

The invention is diagrammatically illustrated, by way of example, in the accompanying drawings, in which:—

Figure 1:
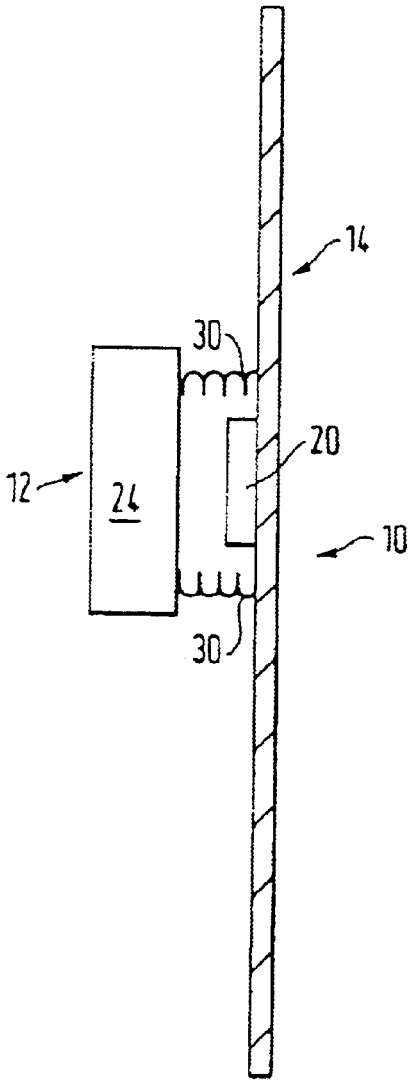
FIG. 1 PRIOR ART
FIGS. 1 and 2 show a prior art loudspeaker as discussed above.
Figure 2:
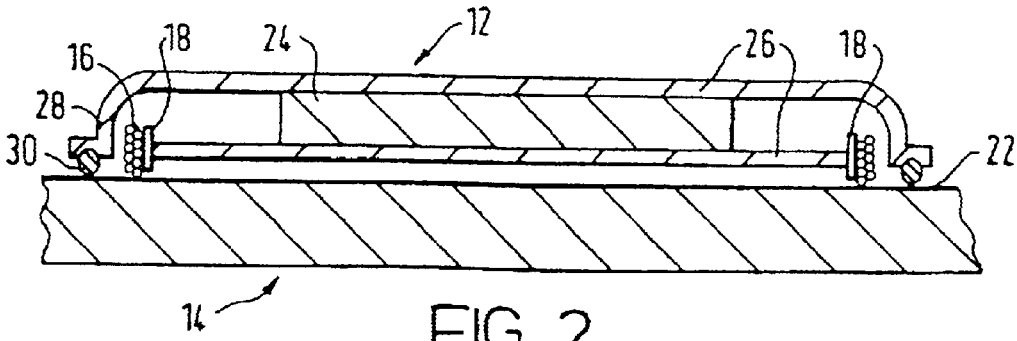
FIG. 2 PRIOR ART
Figure 3:
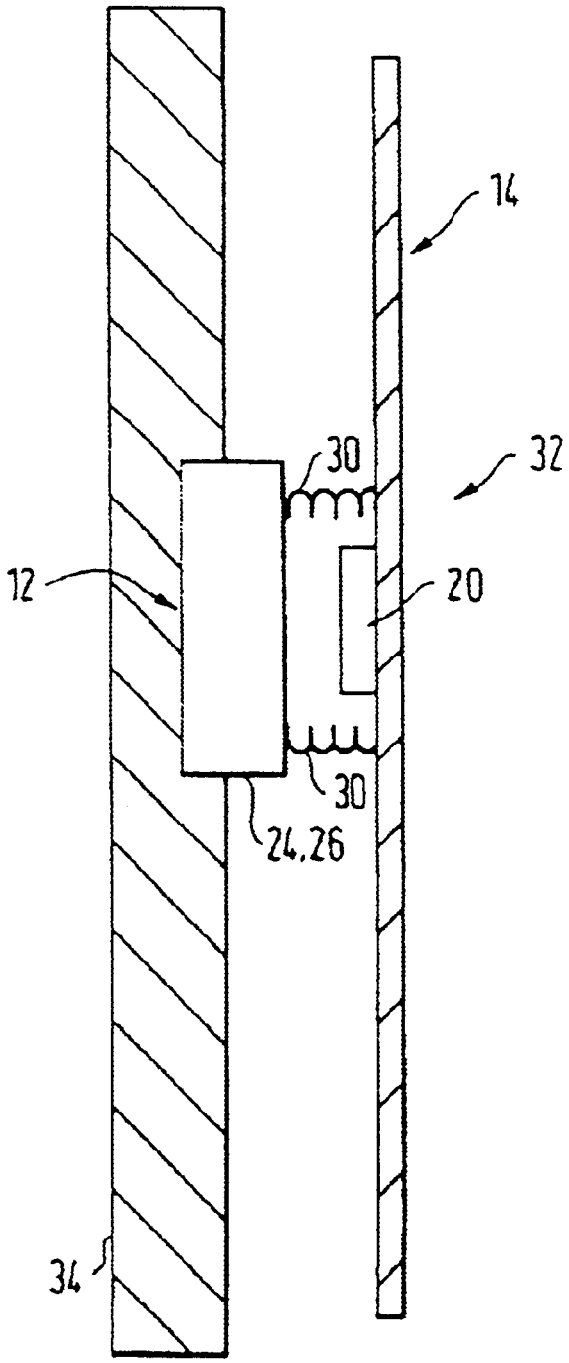
FIG. 3 PRIOR ART
FIG. 3 is a schematic view of another prior art resonant panel loudspeaker mounted to a frame.
Figure 4:
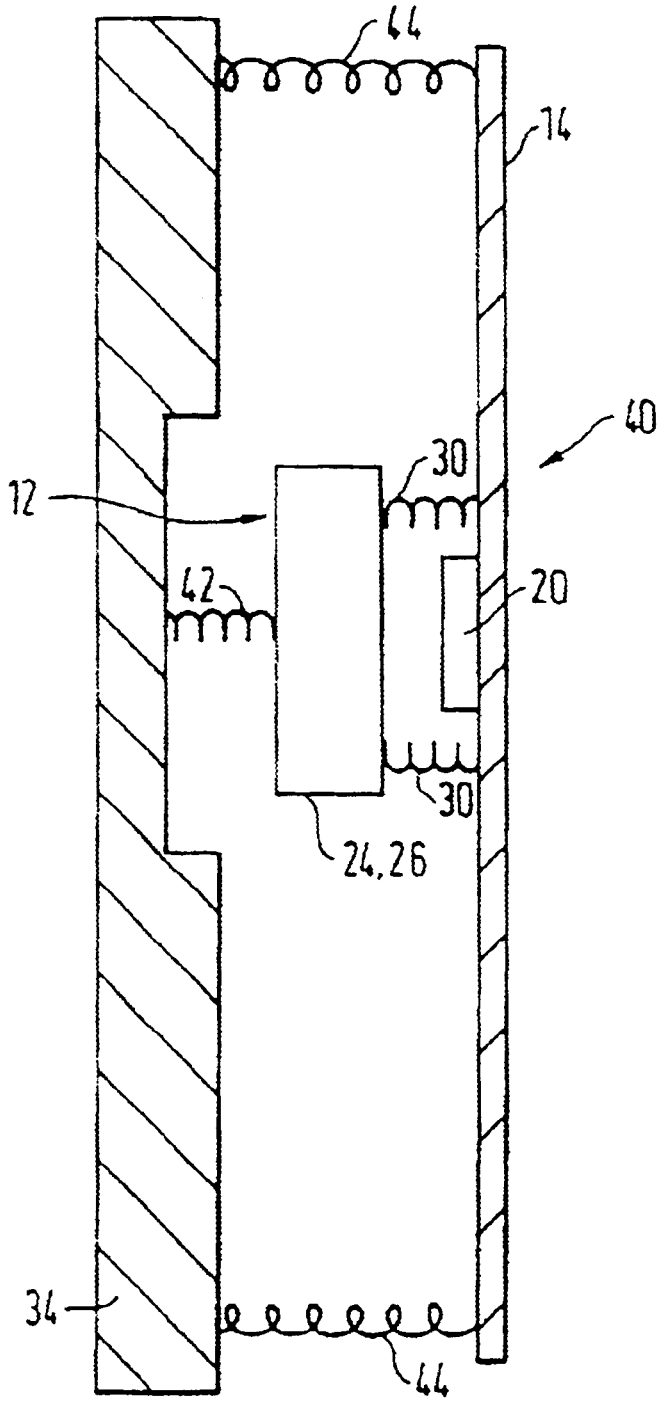
FIG. 4 is a schematic view of an embodiment of resonant panel loudspeaker mounted to a support frame in a manner embodying the present invention.
Figure 5A:
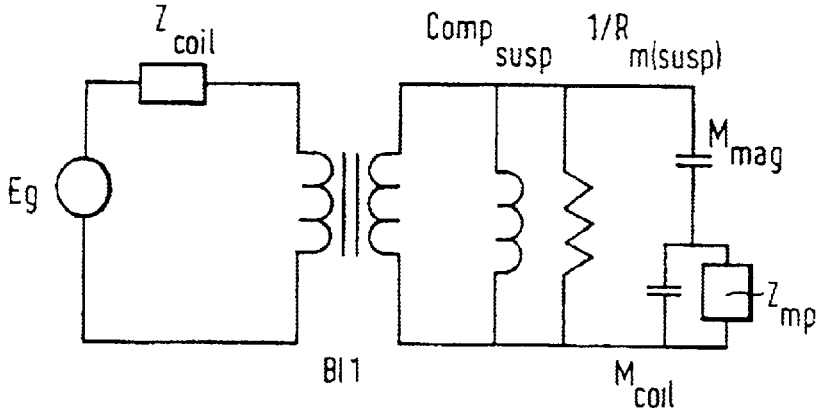
FIG. 5a PRIOR ART
Figure 5B:
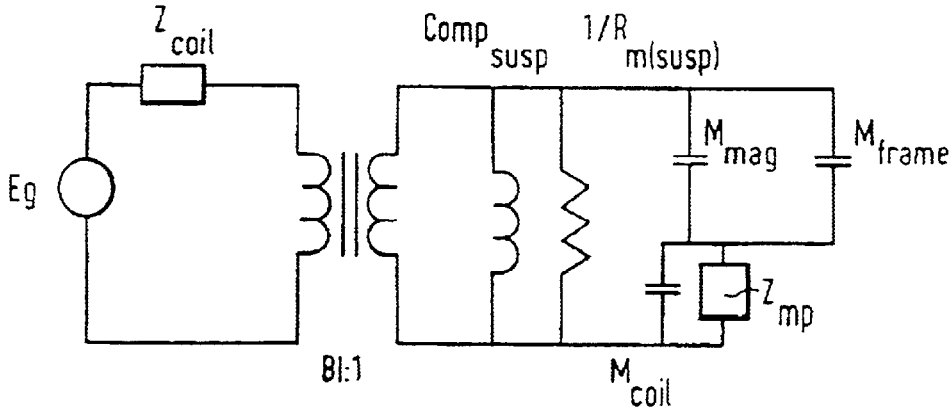
FIG. 5b PRIOR ART
Figure 5C:
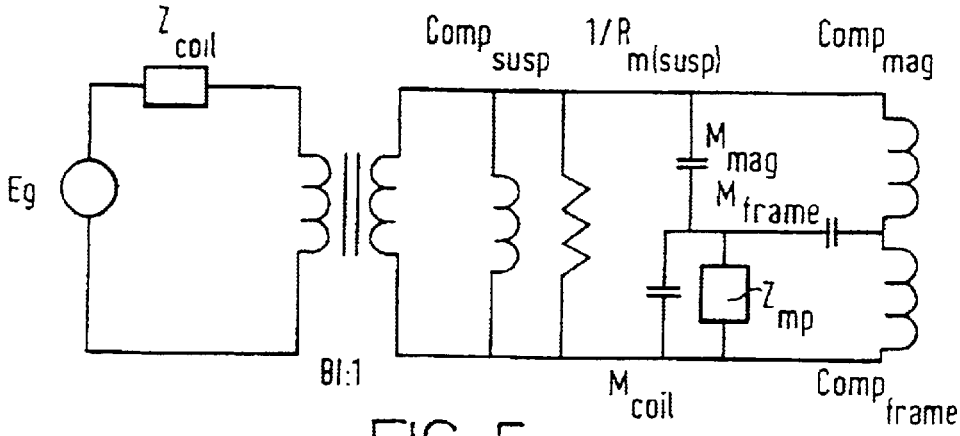
Figure 6:
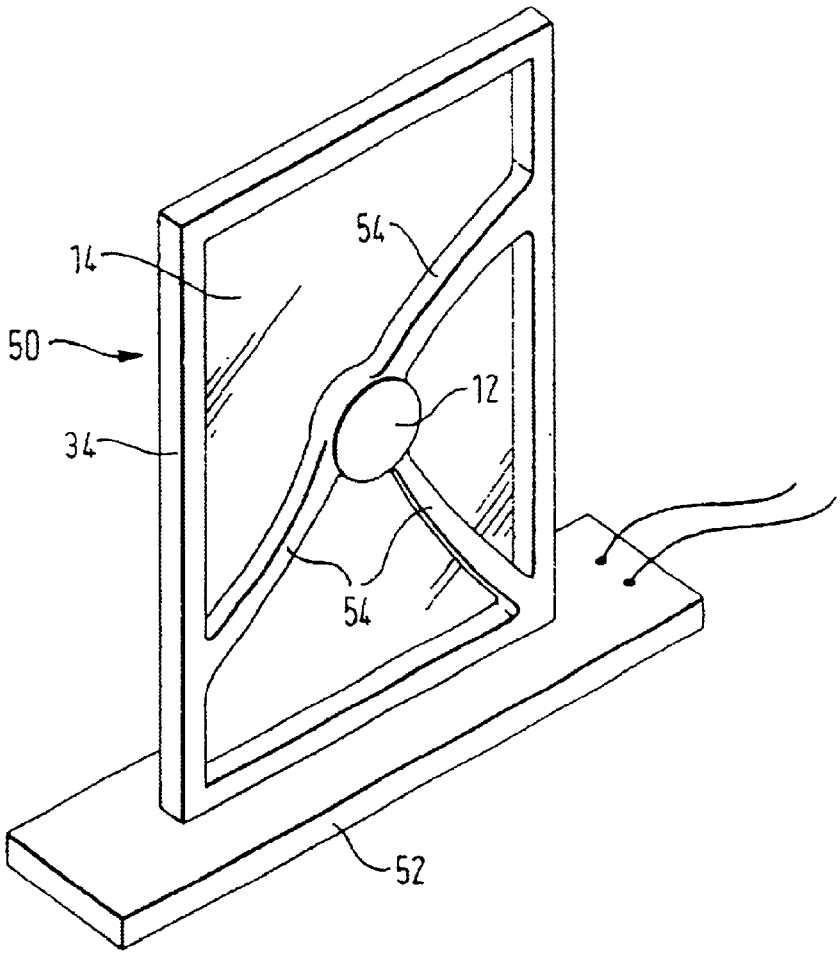
Figure 7:
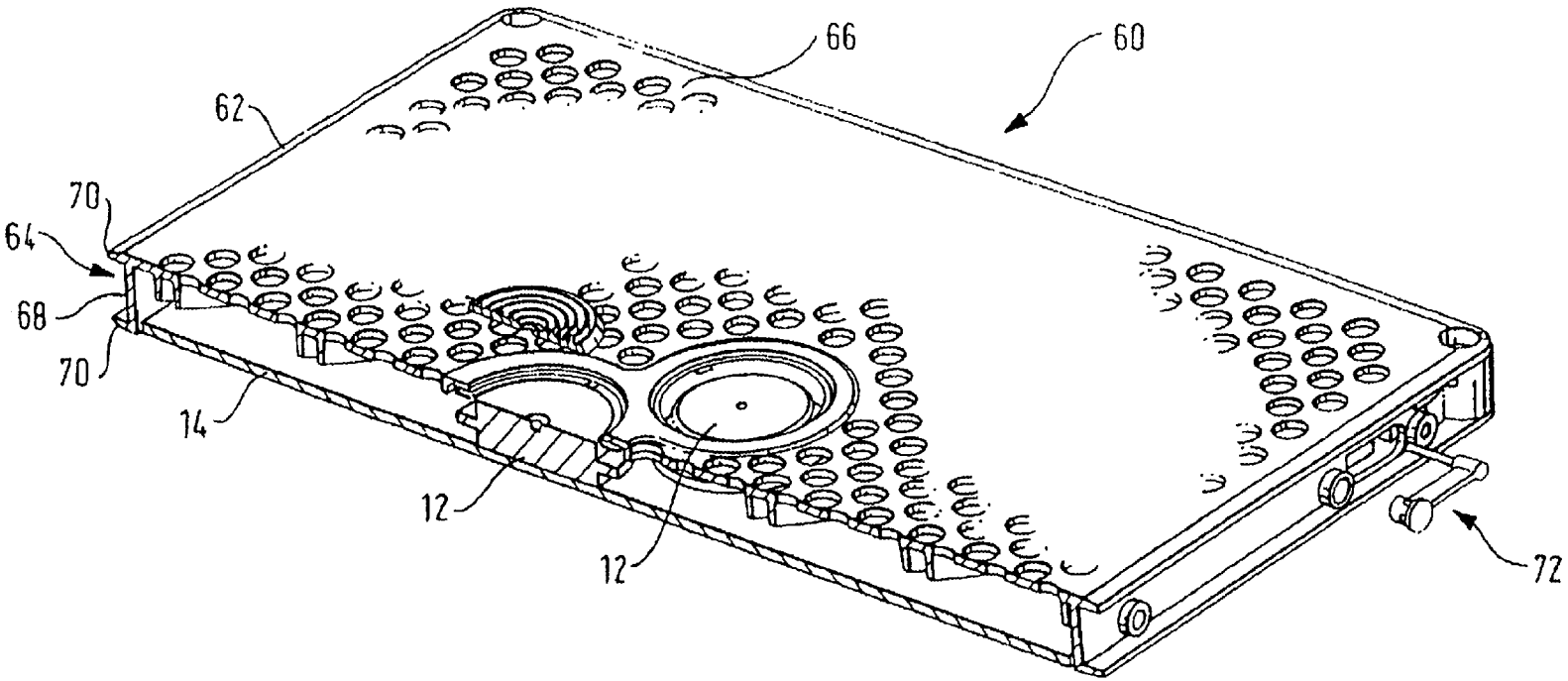
Figure 8:
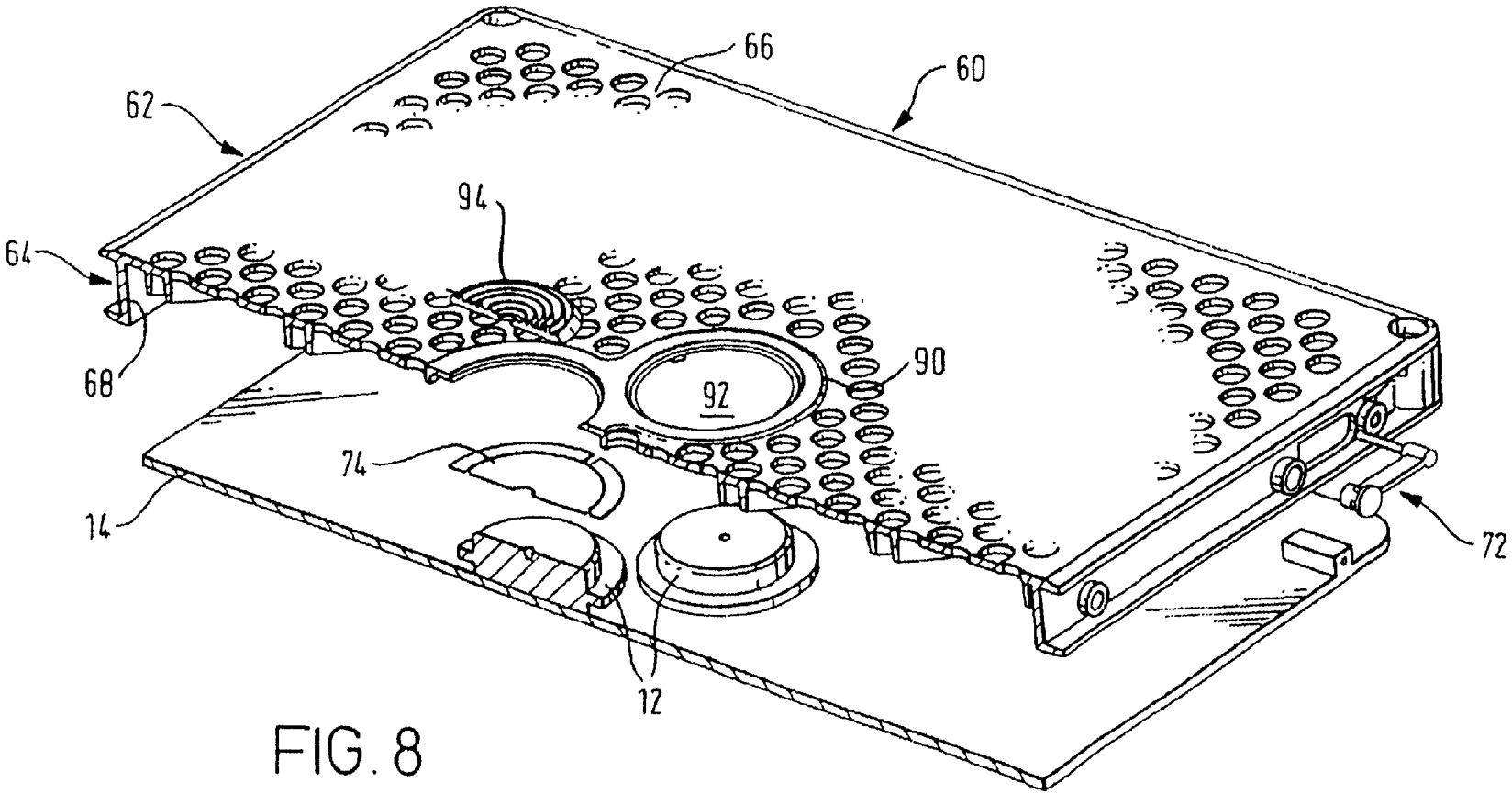
Figure 9:
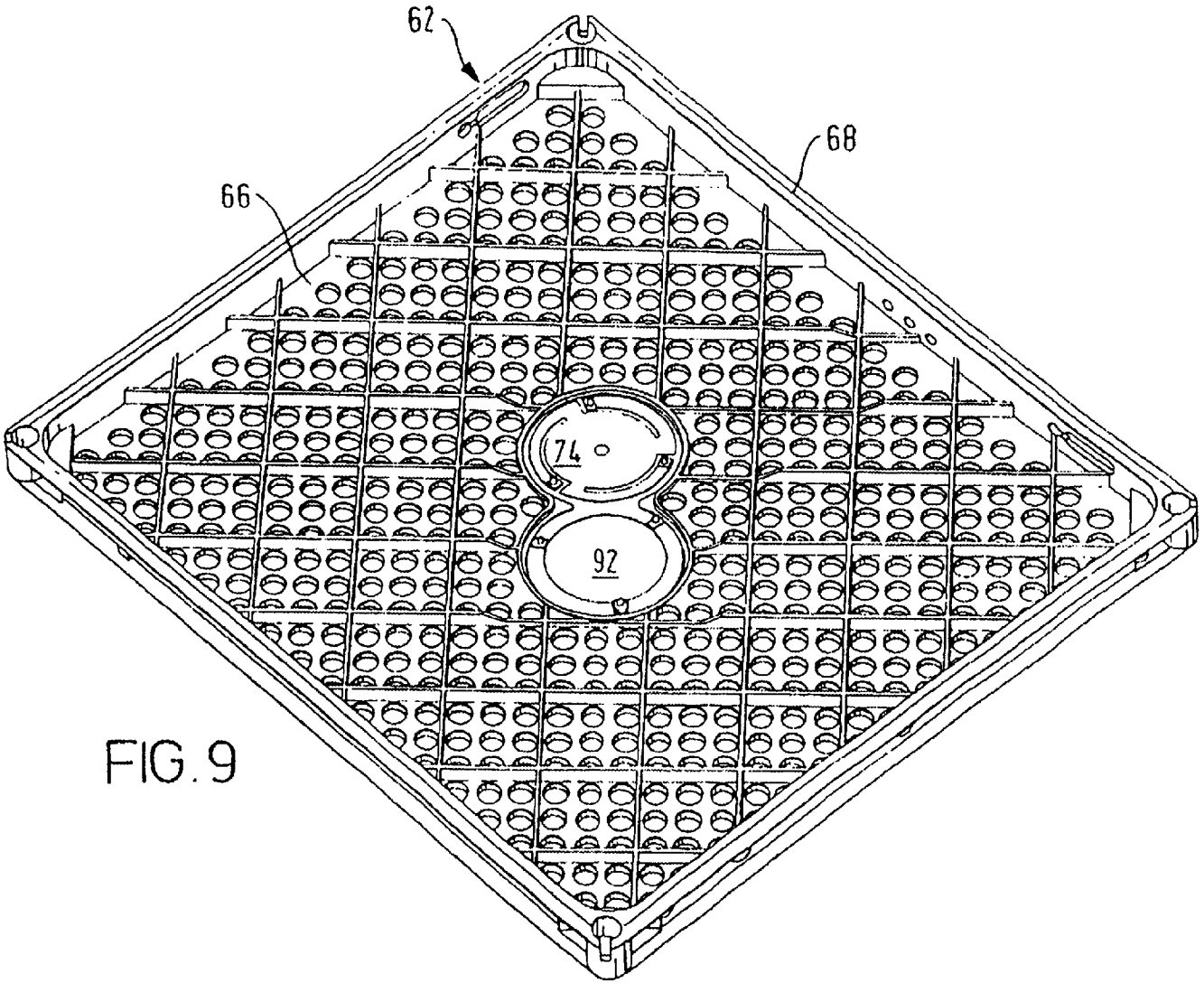
Figure 10:
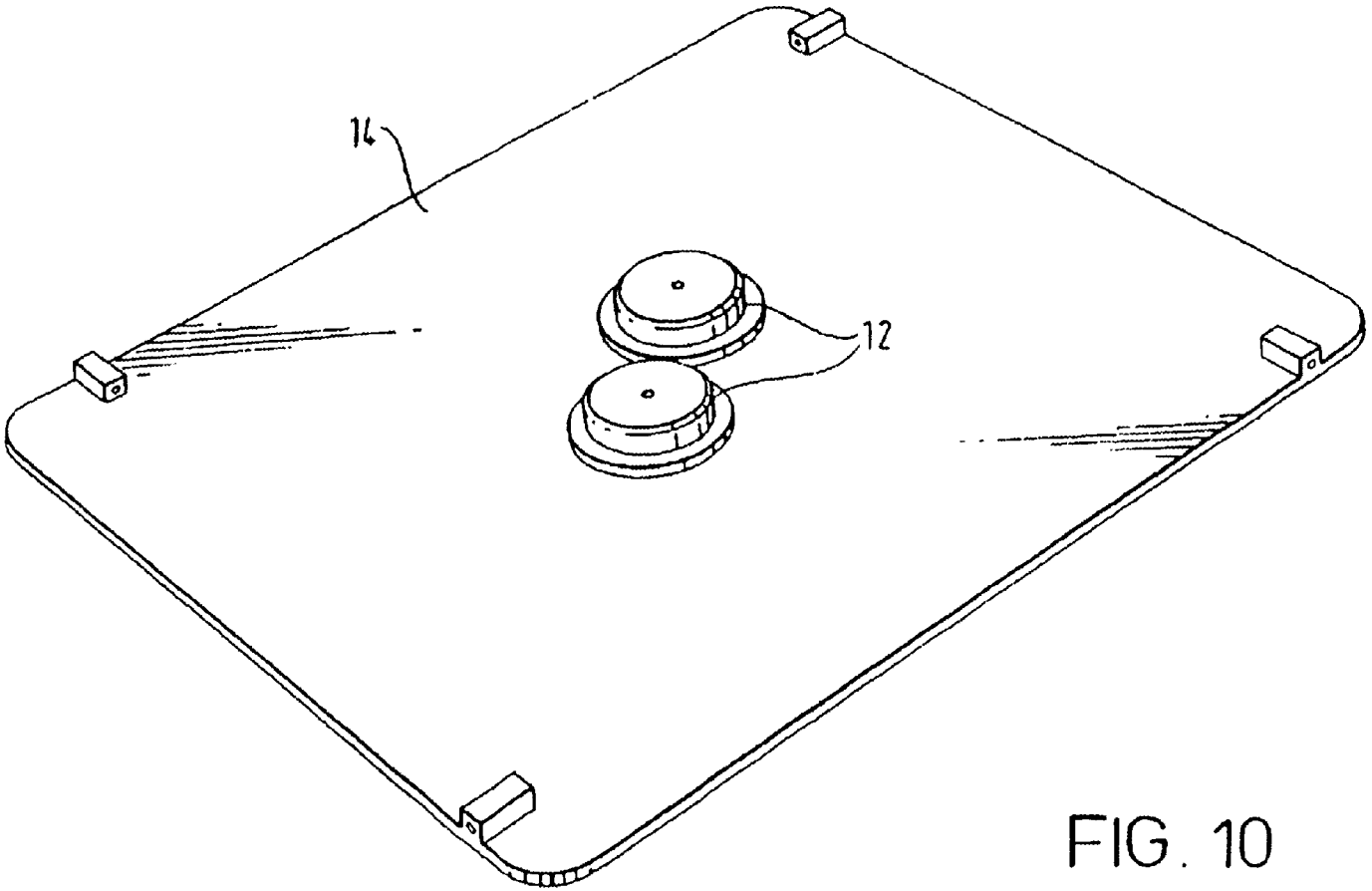
Figure 11:
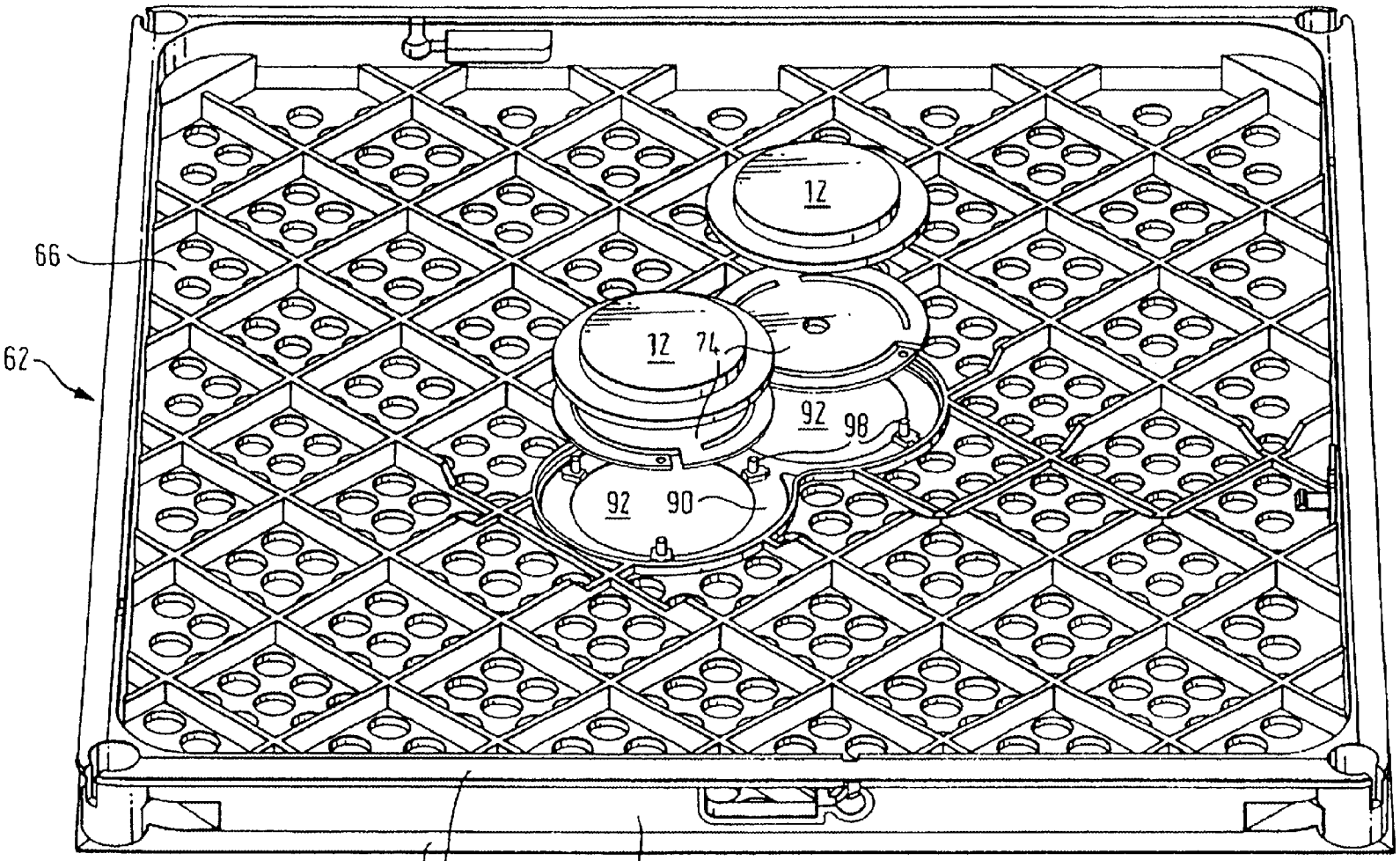
Figure 13:
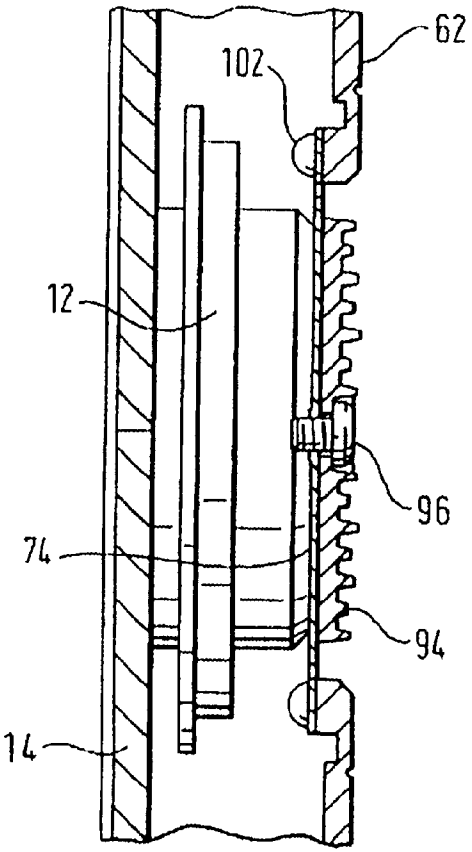
Figure 12:
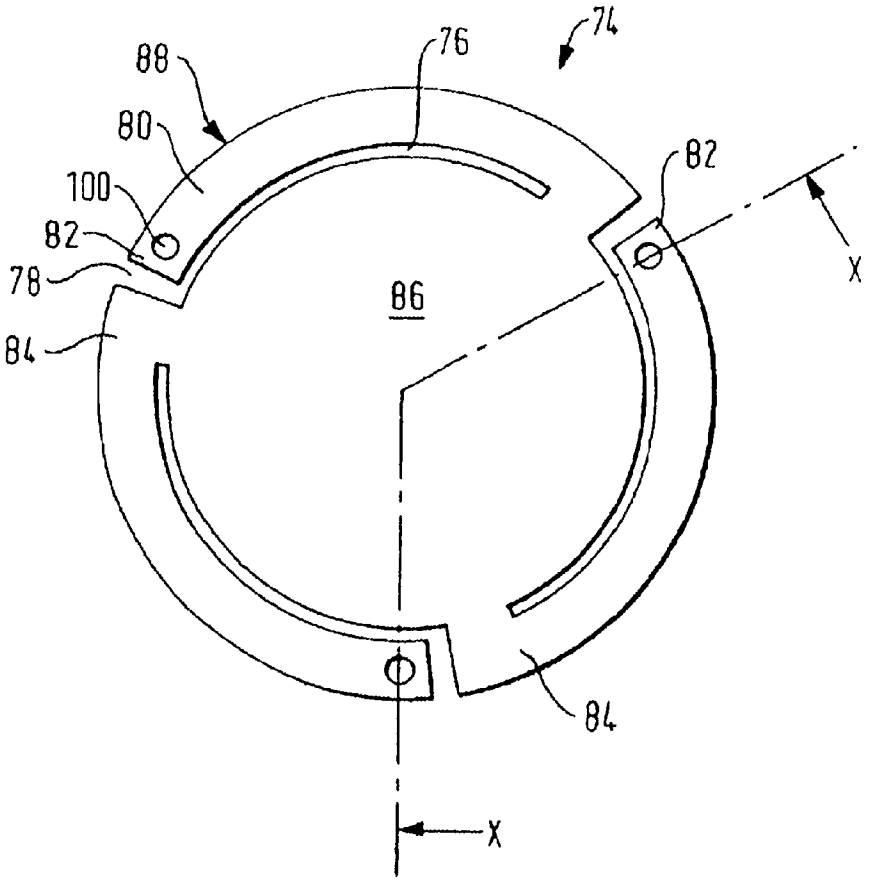

FIGS. 5*a*,5*b*,5*c* show equivalent circuits (mobility analogy) for the resonant panel loudspeakers of FIGS. 1,3 and 4 respectively;

FIG. 6 is a perspective view of a second embodiment of loudspeaker according to the present invention;

FIG. 7 is a perspective cross-sectional view of a modular loudspeaker drive unit in accordance with the present invention;

FIG. 8 is an exploded cross-sectional perspective view of the modular assembly of FIG. 7;

FIG. 9 is a perspective view showing the interior face of a basket or chassis for the modular assembly of FIG. 7;

FIG. 10 is a perspective view of a resonant acoustic radiator panel for the modular assembly of FIG. 7;

FIG. 11 is a second exploded perspective view of the modular assembly of FIG. 7, taken from a side opposite to that shown in FIG. 8;

FIG. 12 is a plan view of a suspension member used in the embodiment of FIG. 7, and FIG. 13 is a scrap cross-sectional side elevation through the modular loudspeaker drive unit of FIG. 7, taken on the line X—X of FIG. 12, and showing the exciter suspension.

DETAILED DESCRIPTION

FIG. 4 illustrates (in diagrammatic form consistent with FIGS. 1 and 3) a resonant panel loudspeaker (40), embodying the present invention. The loudspeaker (40) has many features in common with the loudspeaker (32) of FIG. 3, and thus such features share the same reference numerals. The loudspeaker (40) includes a resilient suspension member (42), e.g. of rubber, disposed between the frame (34) and magnet assembly (24,26) of the exciter (12) to couple the exciter to the frame and resilient suspension (44) disposed around the periphery of the resonant panel (14), between the panel (14) and the frame (34). The resonant panel preferably comprises a resonant member in accordance with International patent application WO97/09842 and counterpart U.S. application No. 08/707,012, filed Sep. 3, 1996.

In FIGS. 5*a*,5*b*,5*c*, circuit equivalents (mobility analogy) are used to illustrate the difference between the resonant mode panel loudspeakers of FIGS. 1, 3 and 4 respectively. In the circuits, inductance represents compliance (i.e. suspension compliance), capacitance represents mass, and resistance represents the inverse of mechanical damping. Thus, in FIG. 5*a*, which is analogous to the loudspeaker (10) of FIG. 1, the following terms apply: $Comp_{susp}$ represents resilience between the magnet assembly (24,26) and the panel (14); $M_{coil}$ represents mass of the coil; $M_{mag}$ represents mass of the magnet; and $Z_{mp}$ represents panel mechanical impedance at driving point.

In FIG. 5*b*, which is analogous to the loudspeaker (32) of FIG. 3, the following extra term applies; $M_{frame}$ represents the mass of the frame. Comparing with FIG. 5*a*, an additional capacitor is placed in parallel with that representing the mass of the magnet assembly $M_{mag}$. This has the effect of reducing the fundamental resonance frequency of the system, which in the circuit is the resonance between the two parallel capacitors $M_{mag}$ and $M_{frame}$ and the inductor labelled $Comp_{susp}$.

In FIG. 5*c*, which is analogous to the loudspeaker 40 of FIG. 4, the following extra terms apply: $Comp_{frame}$ represents resilience between the panel (14) and the frame (34); and $Comp_{mag}$ represents resilience between the frame (34) and the magnet assembly (24,26). Comparing with FIG. 5*b*, we now have a sixth-order system, not a simple second order system. (Damping elements in a parallel with each of $Comp_{frame}$ and $Comp_{mag}$ have been omitted for clarity). It is the added complexity of the system which gives the designer the freedom to "tune" the loudspeaker.

FIG. 6 discloses a second embodiment of resonant panel loudspeaker (50) embodying a resonant panel member (14) generally as disclosed in International patent application WO97/09842 of New Transducers Limited and U.S. counterpart No. 08/707,012.

The loudspeaker (50) comprises a base (52) supporting a generally vertical rectangular light frame (34) which surrounds an acoustic radiator in the form of a stiff lightweight resonant panel (14) which is resiliently suspended in the frame on resilient members, such as rubber-like suspension members, not shown.

An inertial vibration exciter (12) is mounted to the panel to apply bending waves to the panel to cause it to resonate and the exciter is resiliently coupled to the rectangular frame (34) by means of slender resiliently flexible arms (54) which extend between the rectangular frame and the exciter. The arms (54) may, for example, be moulded integrally with the frame (34). Thus the exciter is located and coupled to the frame against movement in the plane of the panel while being free at least to some extent for movement orthogonally to the panel for inertial movement to excite resonances in the panel.

FIGS. 7 to 13 illustrate a third embodiment of the present invention in the form of a flat generally rectangular modular loudspeaker drive unit assembly (60) comprising a generally rectangular stiff lightweight resonant acoustic radiator panel (14), e.g. of the kind described in International patent application WO97/09842 and U.S. Pat. No. 08/707,012 mounted in a surrounding frame or basket (62) with a pair of vibration exciters (12) mounted on the panel (14) to launch bending waves into the panel (14) to cause it to resonate to provide an acoustic output.

The basket (62) is generally rectangular and snugly encloses the radiator panel (14). The basket has a flat perforate base (66) having a surrounding peripheral lip (68) terminated by outwardly projecting flanges (70) which define a surrounding outwardly facing conduit (64) in which services such as electrical input leads to the vibration exciters (12) can be located. The conduit (64) is thus in the form of a channel extending round the periphery of the basket (62). The basket (62) is lightweight and may, for example, be a plastics moulding.

The acoustic radiator (14) is movably suspended on the basket (62) e.g. by its edges in any convenient fashion, e.g. by means of pivoted links (72) hinged at one end to the basket (62) and at the other end to the radiator panel (14).

The pair of inertial electro dynamic vibration exciters (12) are resiliently coupled or suspended on the basket (62) such that their motion normal to the plane of the radiator (14) is substantially unimpeded and to prevent movement of the exciters in the plane of the radiator (14) whereby centration of the relatively movable parts of the exciters is enhanced. This exciter suspension resembles, at least in function, the spider commonly found in the drive unit of a conventional pistonic drive unit, except of course that a conventional spider is provided to ensure centration of a voice coil relative to a chassis. In the resent case the suspension is in the form of a disc-like plate (74) e.g. of springy metal having an inner portion (86) attached to the exciter and an outer portion (88) attached to the basket, the inner and outer portions being separated such that the one can move normally with respect to the other and so that relative movement in the plane of the disc-like plate is prevented. This is achieved by slitting the outer portion (88) of the disc (74) with circumferential and radial slits (76,78) respectively to form three equally circumferentially displaced curved limbs (80) the free ends (82) of which are adapted to be attached to the chassis while the inner ends (84) of the limbs are attached to the inner portion (86). For this purpose the base (66) of the basket (62) is formed with a plate-like exciter locating portion (90) formed with opposed apertures (92) which align with and surround the respective exciters (12) and to which portion (90), the free ends (82) of the limbs (80) are attached. As shown in FIG. 11, the portion (90) may be formed with upstanding pegs (98) adapted to engage in corresponding apertures (100) in the free ends of the limbs (80). Thus the suspension plates can be firmly fixed to the basket by forming the free ends of the pegs (98) into rivet heads (102). A neat sink (94) is attached to each exciter (12) over the top of the suspension plate (74), to assist in cooling the exciters during use and the assembly is held together by a screw (96) sandwiching the upper part (86) of the suspension plate (74) between the exciter and the heat sink.

What is claimed is:

1. A loudspeaker comprising:

a resonant acoustic radiator;

an exciter for applying bending wave energy to the radiator to cause it to resonate, the exciter comprising a voice coil assembly rigidly coupled to the radiator and a magnet assembly;

a support for the radiator; and coupling means for resiliently coupling the magnet assembly to the support;

wherein the radiator is a member having capability to sustain and propagate input vibrational energy by bending waves in at least one operative area extending transversely of thickness to have resonant mode vibration components distributed over said at least one area and have predetermined preferential locations or sites within said area for an exciter, said exciter being coupled to said member at one of said locations or sites to vibrate the member to cause it to resonate forming the said acoustic radiator which provides an acoustic output when resonating.

2. A loudspeaker according to claim 1, wherein the coupling means comprises a resiliently flexible member connecting the exciter and the support.

3. A loudspeaker according to claim 1, wherein the support comprises a structure on which the radiator is suspended.

4. A loudspeaker according to claim 3, wherein the structure comprises a frame surrounding the radiator.

5. A loudspeaker according to claim 3, comprising a resilient suspension by which the radiator is suspended on the structure.

6. A loudspeaker according to claim 5, wherein the resilient suspension is connected to the radiator at positions near to an edge of the radiator.

7. A loudspeaker according to any one of claims 1, 2, 3, 4, 5 and 6, wherein the coupling means is arranged to allow free motion of the exciter in an intended axial direction and to prevent motion of the exciter orthogonally of the axis.

8. A loudspeaker according to claim 1, wherein the coupling means comprises a resilient plate-like member.

9. A loudspeaker according to claim 1, wherein the coupling means comprises a plate having radially inner and outer parts, the outer part being formed by a plurality of arms having free ends, one of said inner and outer parts being adapted for attachment to the support and the other of said inner and outer parts being adapted for attachment to the exciter.

10. A loudspeaker according to claim 9, wherein the plate is formed with a series of circumferential and radial slits defining the arms whereby an outer part of the plate can be fixed to the support and an inner part of the plate can be fixed to the exciter.

11. A loudspeaker according to claim 10, comprising a heat sink fixed to the inner part of the plate to assist in cooling the exciter.

12. A loudspeaker according to claim 1, wherein the support surrounds the radiator.

13. A loudspeaker according to claim 12, wherein the support is a tray-like member having a surrounding peripheral lip.

14. A loudspeaker according to claim 13, wherein the tray-like member is perforate.

15. A loudspeaker according to claim 1, wherein the radiator comprises a substantially flat panel.

16. A loudspeaker comprising a resonant acoustic radiator, an exciter coupled to the radiator to apply bending wave energy to the radiator to cause it to resonates, a support for the radiator, and coupling means for resiliently coupling the exciter to the support, wherein the exciter comprises a voice coil assembly and a magnet assembly, the resonant acoustic radiator is a member having capability to sustain and propagate input vibrational energy by bending waves in at least one operative area extending transversely of thickness to have resonant mode vibration components distributed over said at least one area and have predetermined preferential locations or sites within said area for an exciter, and said exciter is coupled to said member at one of said locations or sites to vibrate the member to cause it to resonate forming the said acoustic radiator which provides an acoustic output when resonating.

17. A loudspeaker according to claim 2, wherein the support comprises a structure on which the radiator is suspended.

18. A loudspeaker according to claim 4, comprising a resilient suspension by which the radiator is suspended on the structure.

19. A loudspeaker according to claim 7, wherein the coupling means comprises a resilient plate-like member.

* * * * *